United States Patent [19]

Jingu et al.

[11] Patent Number: 5,000,598

[45] Date of Patent: Mar. 19, 1991

[54] GUIDE MECHANISM FOR DOT MATRIX PRINTER

[75] Inventors: Toshihiro Jingu, Hiratsuka; Katsuyoshi Yokota, Kamakura; Ryuji Yamazaki, Isehara, all of Japan

[73] Assignee: NCR Corporation, Dayton, Ohio

[21] Appl. No.: 385,334

[22] Filed: Jul. 24, 1989

[30] Foreign Application Priority Data

Sep. 16, 1988 [JP] Japan ..... 63-230159

[51] Int. Cl.[5] ..... B41J 13/10

[52] U.S. Cl. ..... 400/642; 400/645

[58] Field of Search ..... 400/595, 597, 603, 603.1, 400/605, 607, 607.2, 642, 644, 643, 645, 645.1, 645.2, 645.3, 645.4, 645.5, 646, 647, 647.1, 599, 578, 619, 621

[56] References Cited

U.S. PATENT DOCUMENTS

| | | | |
|---|---|---|---|
| 4,197,023 | 4/1980 | DeBoo et al. | 400/578 |
| 4,234,261 | 11/1980 | Hendrischk et al. | 400/621 |
| 4,586,839 | 5/1986 | Iwagami | 400/619 |

FOREIGN PATENT DOCUMENTS

| | | | |
|---|---|---|---|
| 0176863 | 8/1987 | Japan | 400/642 |

*Primary Examiner*—Edgar S. Burr
*Assistant Examiner*—C. A. Bennett
*Attorney, Agent, or Firm*—Wilbert Hawk, Jr.; Albert L. Sessler, Jr.; George J. Muckenthaler

[57] ABSTRACT

A guide mechanism for a slip paper path and for a receipt paper path. A spring plate is provided at the confluence of the paper paths to prevent the slip from entering the receipt paper path. The spring plate is engaged by the receipt to allow the receipt to be fed from the receipt paper path into the slip paper path.

8 Claims, 3 Drawing Sheets

GUIDE MECHANISM FOR DOT MATRIX PRINTER

BACKGROUND OF THE INVENTION

In the field of printing, the most common type printer has been the printer which impacts against record media that is caused to be moved past a printing line or line of printing. As is well-known the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and for journal printing operations, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like record media while the carriage and print head are moved above and across the form or like record media in the horizontal direction.

Further, in the wire matrix printer which is utilized for receipt, slip and journal printing operations, the individual print heads may be vertically oriented and printing performed by means of the print wires moving downwardly to impact on the record media. Alternatively, the individual print heads may be horizontally oriented and printing performed by means of the print wires moving horizontally to impact on the record media. A preferred number of four of such individual print heads is common in known arrangements.

The dot matrix printer is commonly used in an electronic cash register (ECR) or in a point of sale (POS) terminal. The register or the terminal includes means for guiding the receipt and means for guiding the slip past the printing station and the guiding means is selected in a manner dependent upon the printing operation.

The printer in an ECR or a POS terminal has the function of printing a receipt which is handed to the customer and also has the function of printing a journal which is retained as a record of the transaction. Additionally, the printer may have the function of printing on a slip or like form which is used in certain retail operations. Separate printers have been used for printing the receipt, the journal and the slip. Other arrangements have used one or two printers respectively having two or three printing functions and commonly referred to as multifunction printers. A roll of paper is used for the receipt printing and a roll of paper is used for the journal printing, whereas a slip may consist of a single sheet or a form may consist of a set of sheets.

In apparatus of the type wherein printing on receipts, journals and slips is performed by one printer, there is provided a dual printing mechanism. Printing on the journal paper is performed by one printing mechanism and printing on the receipt and/or slip is performed by the other printing mechanism of the printer. In some cases, printing on the receipt and on the slip is performed by one printer and printing on the journal is performed by another printer.

In the printer mentioned above wherein printing is performed on the receipt and/or slip by the other printing mechanism, a special device is required for switching the printing function from receipt printing to slip printing or from slip printing to receipt printing. Additionally, means is required for controlling the operation of the special device.

Representative documentation in the field of guide mechanisms includes U.S. Pat. No. 4,197,023, issued to J. L. DeBoo et al. on Apr. 8, 1980, which discloses a rigid paper guide chute having a flexible member secured thereto and extending around a platen a sufficient distance to assure that the paper is directed past the print mechanism and through an exit.

U.S. Pat. No. 4,234,261, issued to W. Hendrischk et al. on Nov. 18, 1980, discloses drives and paths for paper web or for individual forms. Switches are provided along the paths for controlling the flow of the web or form.

U.S. Pat. No. 4,586,839, issued to F. Iwagami on May 6, 1986, discloses an upper paper guide and a lower paper guide integrated as one device and rotatably supported to provide a path for the paper and to permit removal of the platen.

SUMMARY OF THE INVENTION

The present invention relates to a dot matrix printer for impact printing on record media. The dot matrix printer includes two separate printing stations, one station positioned near the front of the printer and the other station positioned rearwardly of the one station. The two stations are arranged in tandem manner and the two separate print head carriages are coupled to a drum cam type drive mechanism positioned between the two carriages. The two carriages along with the associated print heads are driven by the drum cam type drive mechanism in equal and opposite directions during printing operations.

The one station near the front of the printer is utilized for dot matrix printing on a receipt and on a slip or like business form and is referred to as the receipt/slip station. The other station rearwardly of the one station is utilized for dot matrix printing on a journal and is referred to as the journal station. A plurality of solenoid driven, single wire print heads are supported in spaced relationship on each carriage for performing the printing operations at the two printing stations.

A spring plate is attached to a frame portion of the printer near the receipt/slip station and fills a space between a guide structure forming a first feed path for one record medium and a guide structure forming a second feed path for another record medium. The spring plate is in contact with a guide surface against which one record medium is pressed with a light force permitting advancing of such one record medium past the receipt/slip station for printing. The spring plate fills the space between the feed paths and guides the other record medium along the second feed path and deters the other record medium from entering the first feed path.

In accordance with the present invention, there is provided a printer having a printing station, a first guide structure forming a feed path for a first record medium and a second guide structure forming a feed path for a second record medium, the feed paths being confluent adjacent the printing station, and guide means at the confluence of the feed paths and comprising a spring plate pressing the first record medium in contact with a surface of the first guide structure and guiding the second record medium along said feed path for the second record medium and preventing entering of the second record medium into said first feed path, and for guiding said first record medium past said printing station.

In view of the above discussion, a principal object of the present invention is to provide an improved guide mechanism in a dot matrix printer.

Another object of the present invention is to provide a guide mechanism which is constructed to be easily attached to a dot matrix printer.

An additional object of the present invention is to provide a guide mechanism that is simple and low cost for use in a multifunction printer.

A further object of the present invention is to provide a guide mechanism located at the confluence of two feed paths and of a resilient nature to prevent one record medium from entering one feed path while permitting advancing of another record medium to the printing station.

Additional advantages and features of the present invention will become apparent and fully understood from a reading of the following description taken together with the annexed drawing.

DESCRIPTION OF THE PREFERRED EMBODIMENT

Figure 1:
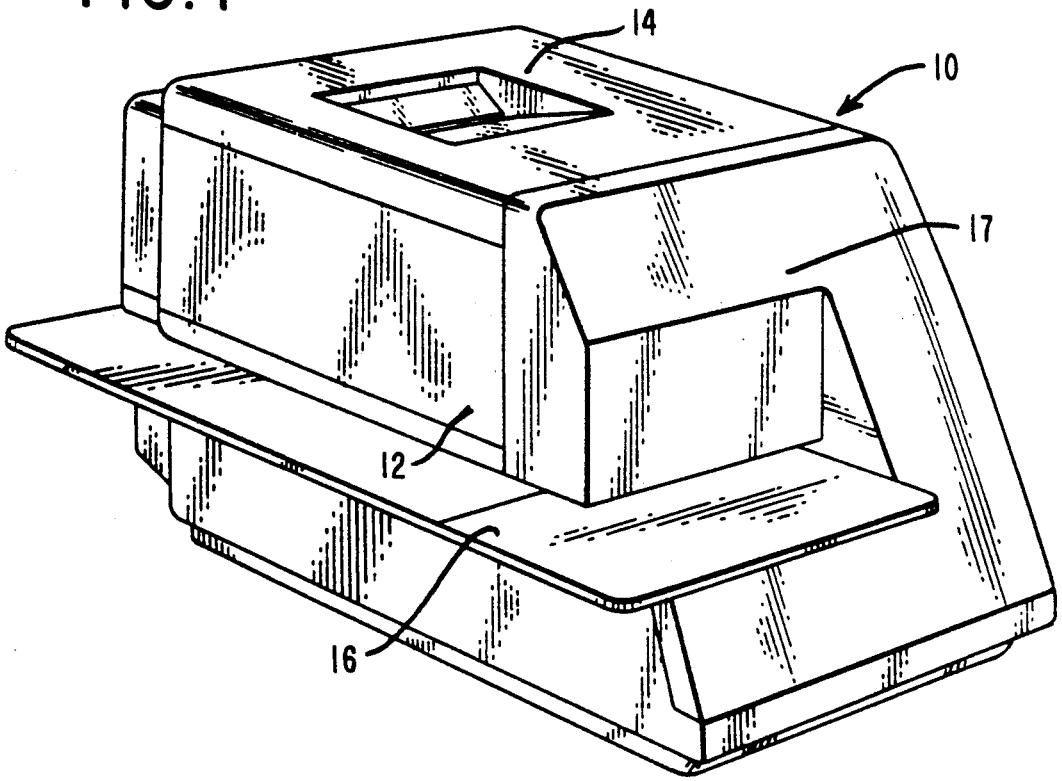
FIG. 1 is a perspective view of a dot matrix printer incorporating the subject matter of the present invention.

Referring now to FIG. 1, a printer 10 is designed as a two station, receipt/slip and journal printer. The receipt/slip printing station occupies a front portion 12 and the journal printing station occupies a rearward portion 14 of the printer. A slip table 16 is provided along the left hand side of the printer 10. A front cover 17 swings toward the right to expose certain operating parts of the printer 10.

Figure 2:
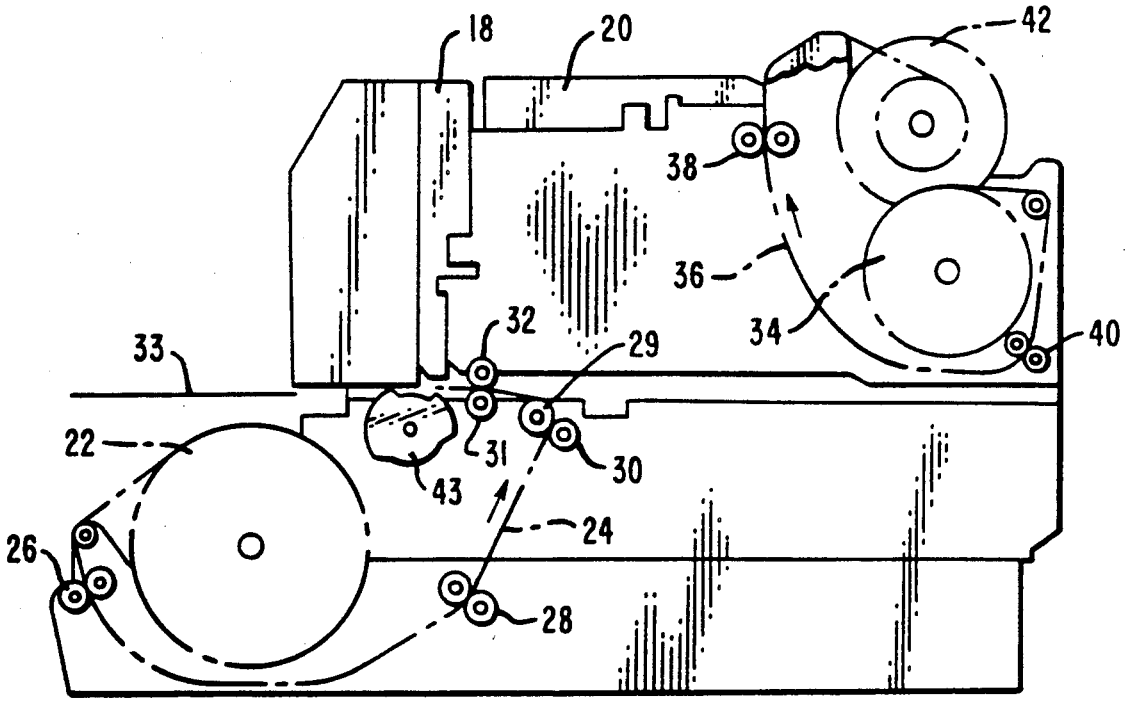
FIG. 2 is a right side elevational view in diagrammatic form showing the arrangement of certain elements of the printer.
Figure 3:
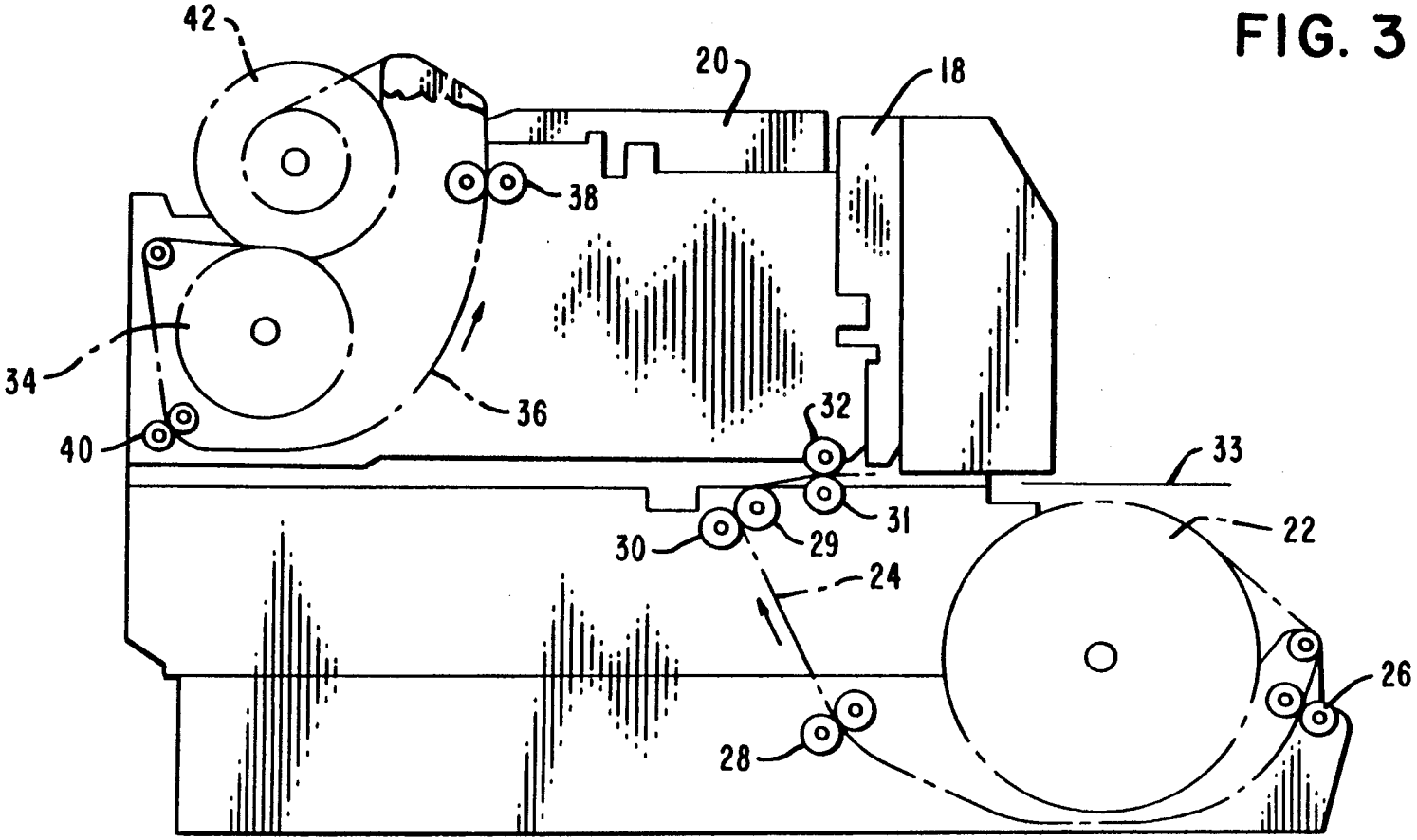
FIG. 3 is a left side elevational view in diagrammatic form showing the arrangement of such certain elements of the printer.

FIGS. 2 and 3 are right and left side elevational views and show certain elements of the printer 10 in diagrammatic form. The receipt/slip portion 12 and the journal portion 14 include individual print wire solenoids (not shown) along with a ribbon cassette 18 for the receipt/slip printing operation and a ribbon cassette 20 for the journal printing operation. A roll 22 of receipt paper is journaled at the front of the printer 10 and the receipt paper 24 is driven and guided by appropriate pairs of rollers, as 26, 28, 30 and 32 in a path past the receipt/slip printing station for printing operation and for issuance of a receipt 33 after cutting thereof from the receipt paper 24. A supply roll 34 of journal paper is positioned in a cradle at the rear of the printer 10 and the journal paper 36 is driven and guided by appropriate pairs of rollers, as 38 and 40, in a path from the supply roll 34, past the journal printing station, and onto a take-up roll 42. A timing plate 43 (FIG. 2) is provided at the receipt/slip printing station for positioning the receipt/slip feed rolls.

Figure 4:
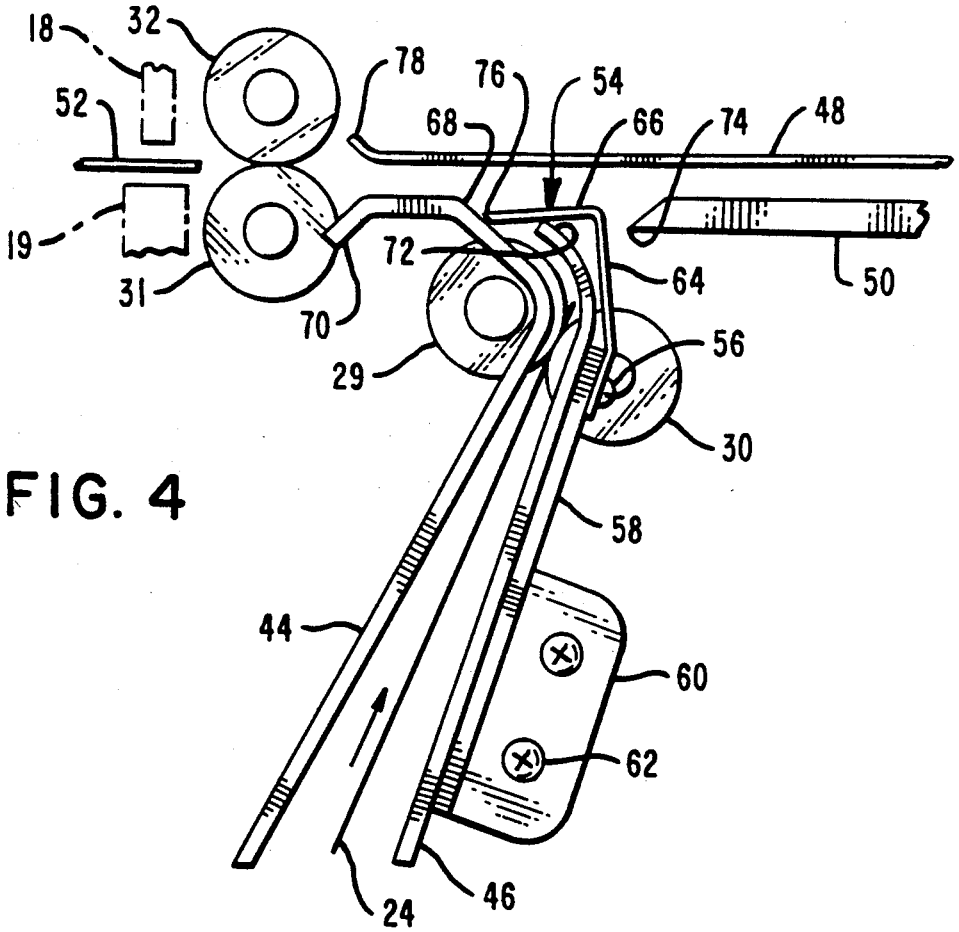
FIG. 4 is a side elevational view, partly in section, of the guide mechanism of the present invention.

A paper feed guide mechanism is provided in the printer 10 for use at the receipt/slip printing station located at the front of the printer 10. FIG. 4 is a side elevational view, partly in section, of the guide structure adjacent the receipt/slip printing station. A guide plate 44 and an opposed guide plate 46 are disposed in an upwardly direction and are positioned to form a guide path for the receipt paper 24 toward the receipt/slip printing station. A lower portion of the ribbon cassette 18 and a portion of a platen 19 are shown to indicate the position of the receipt/slip printing station at the front of the printer 10. A pair of guide rolls 29 and 30 (see also FIGS. 2 and 3) are positioned to feed the receipt paper 24 along the guide path formed by plates 44 and upwards toward the receipt/slip printing station.

A guide plate 48 and an opposed guide plate 50 are disposed in a horizontal direction and are disposed to form a guide path for a slip or like form 52. A pair of feed rolls 31 and 32, (see also FIGS. 2 and 3) are positioned to receive and feed the slip 52 toward the right in FIG. 4 and into position for printing at the receipt/slip printing station.

A spring plate 54 is positioned at the confluence of the receipt paper guide path and the slip guide path. The spring plate 54 is secured with screws, as 56, to a plate 58 which is a part of a support plate 60. The plate 58 provides support for the guide plate 46. The support plate 60 is attached to a side wall (not shown) of the printer by screws 62.

The spring plate 54 is formed of a generally upwardly extending portion 64 and a generally horizontal portion 66. The portion 66 is in contact with a surface 68 of the guide plate 44 above the receipt feed roll 29. The portion 66 of the spring plate 54 provides a light pressing force against the surface 68.

When a receipt is printed, the receipt paper is advanced from the receipt roll 22 (FIGS. 2 and 3), upwards in the paper guide path formed by plates 44 and 46, and driven by the feed roll 29 and the pressure roll 30 toward the receipt/slip printing station. The receipt paper 24 is driven into contact with portion 66 of the spring plate 54 at the point thereof where an end 76 of the spring plate 54 is in contact with portion 68 of the guide plate 44. The spring plate 54 is pushed up a slight amount by the receipt paper 24 and away from contact with the surface 68 to permit the receipt paper to advance between the feed roll 31 and the pressure roll 32 toward the receipt/slip printing station. The receipt paper 24 is advanced by rolls 31 and 32 toward the left in FIG. 4 and past the receipt/slip printing station. After printing, the receipt paper 24 is cut by cutting mechanism (not shown) into appropriate lengths containing the details of the transaction and the receipt is then given to the customer.

When a slip 52 is inserted from the front of the printer 10 (from left to right in FIG. 4), the spring plate 54 is in contact with the portion 68 and prevents the slip from entering the receipt paper guide path formed by plates 44 and 46. The slip is allowed to be advanced by the rolls 31 and 32 into the slip paper path, as defined by guide plates 48 and 50, in a direction toward the rear of the printer 10, to the right as viewed in FIGS. 2 and 4, to accommodate a printing operation on the slip. After printing on the slip 52, the feed rolls 31 and 32 are reversed to move the slip toward the left in FIG. 4 and out the front of the printer 10.

It is seen from FIG. 4 that the two guide plates 44 and 46 which make up the guide structure for the receipt paper 24 are formed generally upwardly toward the receipt/slip printing station which is positioned forward of the rollers 31 and 32 (FIG. 2). The portion 68 of the guide plate 44 curves toward and has an end portion 70 adjacent the roller 31. The guide plate 46 includes an end portion 72 curving toward the rollers 31 and 32 and in contact with the generally horizontal portion 66 of the spring plate 54. The guide plates 44 and 46 are formed to permit the rollers 29 and 30 to extend therethrough in order to advance the receipt paper 24 toward the receipt/slip printing station.

The guide plate 50 has an end portion 74 rearward of the spring plate 54 and spaced therefrom to allow the spring plate to move a slight amount from contact of the end 76 of the horizontal portion 66 of the spring plate with the curved portion 68 of the guide plate 44. The portion 66 of the spring plate 54 aids in guiding the slip 52 into the guide path formed by plates 48 and 50. The guide plate 48 of the second guide structure has an end portion 78 adjacent the roller 32 which cooperates with the curved portion 68 of the guide plate 44 to provide a path for both the receipt paper 24 and the slip 52 in the area rearward of and adjacent the rollers 31 and 32. The rollers 31 and 32 provide the means for advancing both the receipt paper 24 and the slip 52 past the receipt/slip printing station. Appropriate controls in the form of advancing the receipt paper 24 and the slip 52 and for reversing the slip 52 are provided in the printer 10. When a receipt is to be printed, the receipt paper 24 is driven by rolls 29 and 30 past the end 76 of the spring plate 54 and driven by rolls 31 and 32 past the receipt/slip printing station and toward the left in FIG. 4 (out the front of the printer 10 and providing a receipt to the customer after cutting the receipt paper by cutting mechanism).

When a slip 52 is to be printed, the slip is placed on the slip table 16 for insertion into the printer 10 (FIG. 1), the slip is driven toward the right in FIG. 4 by feed rolls 31 and 32 to the proper print line position on the form, the printing is accomplished on the form, and the form is then reversed in direction toward the left in FIG. 4 and out the front of the printer 10.

Figure 5:
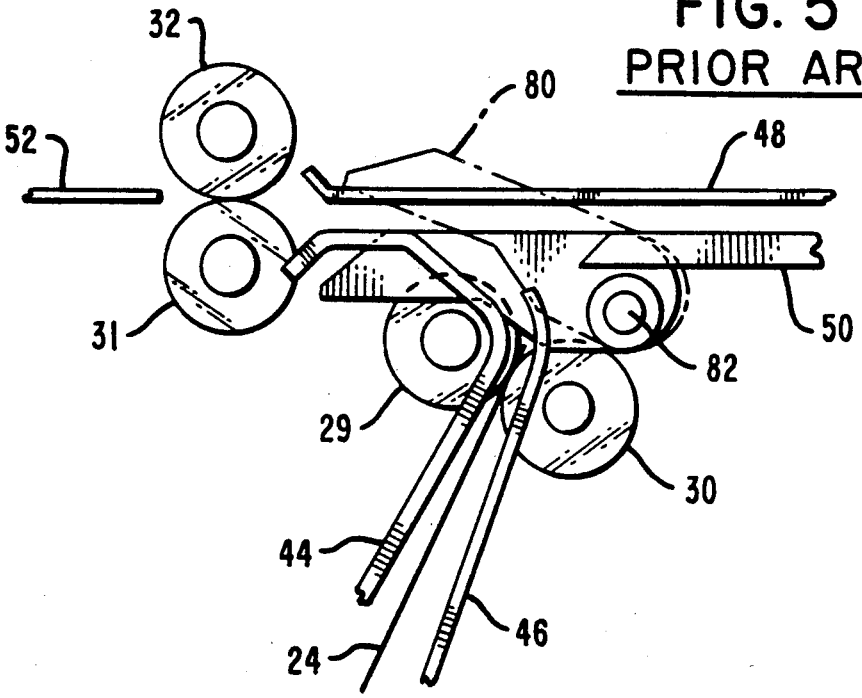
FIG. 5 PRIOR ART
FIG. 5 is a side elevational view of prior art guide mechanism.

FIG. 5 is prior art structure and shows a similar arrangement as FIG. 4 but uses a guide arm 80 which is pivoted on a pivot shaft 82. The guide arm 80 is rotated upwardly via a link (not shown) connected to a solenoid (also not shown) to open the path from the receipt paper path to the slip paper path to permit feeding and printing the receipt.

When it is desired to print on a slip 52 by using the prior art structure, the guide arm 80 is rotated downwardly to shut the feed path of the receipt paper 24 and the slip is allowed to be advanced by the rolls 31 and 32 into the path for the slip in a direction toward the rear of the printer 10 to accommodate a printing operation on the slip 52.

The guide mechanism of the prior art shown in FIG. 5 provides for switching the function of printing on receipt paper to printing on a slip by means of a complicated arrangement. Although not shown, the prior art mechanism uses a guide arm, a link and a solenoid or like actuator, a spring for returning the guide arm, and a control and drive circuit for the solenoid.

The guide mechanism of the present invention uses a simple spring plate 54 in place of all the parts mentioned above. The plate 54 is advantageous in reducing the number of parts, in facilitating manufacture and assembly of the guide mechanism, in reducing the manufacturing cost, and in improving the quality of the guide mechanism.

It is thus seen that herein shown and described is a guide mechanism wherein the light pressing force of a spring plate is used to guide and control the receipt paper along a path toward the printing station and the spring plate is used to close the path to entrance of a slip printed at the same printing station. The spring plate provides a light pressing force and the receipt paper has a proper flexural rigidity to enable feeding of the receipt paper without buckling or tearing thereof.

The apparatus and arrangement enable the accomplishment of the objects and advantages mentioned above, and while the preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A guide mechanism for use in a printer having a printing station for printing on a first record medium and for printing on a second record medium, said guide mechanism comprising a first guide structure comprising a first guide plate and a first opposed guide plate providing a first path for the first record medium, a second guide structure comprising a second guide plate and a second opposed guide plate providing a second path for the second record medium and being confluent with the path for the first record medium, and guide means positioned at the confluence of the paths of the first and the second record mediums and comprising a spring plate having one end thereof pressing against one surface of the first guide plate of the first guide structure, said spring plate comprising a first portion secured to said first opposed guide plate and a second portion formed integral with and approximately normal to the first portion and said one end of the second portion of said spring plate being engageable with said one surface of said first guide plate, said one end of the second portion of said spring plate being moved from contact with said one surface of said first guide plate solely by passage of said first record medium between said one end and said one surface to permit advancement of said first record medium in a path toward the printing station, and said spring plate being formed to return said one end thereof into contact with said one surface and in position to close the path of said first record medium and to direct said second record medium along the path of said second guide structure.

2. The guide mechanism of claim 1 wherein said second guide plate extends from said printing station and said second opposed guide plate is spaced from said second guide plate and has an end portion approaching said spring plate at the confluence of the two record medium paths, the end portion being positioned to permit said spring plate to be moved from contact with said one surface.

3. The guide mechanism of claim 1 wherein said first guide plate is formed upwardly toward said printing station and said first opposed guide plate is spaced from said first guide plate and has an end in contact with said spring plate and said first opposed guide plate is formed to guide said first record medium along said first guide plate toward said printing station.

4. The guide mechanism of claim 3 wherein said first guide plate includes a curved portion extending past said spring plate and toward said printing station and said curved portion provides a path for said second record medium adjacent said printing station and at the confluence of the record medium paths.

5. In a printer having a printing station for printing on a first record medium and for printing on a second record medium, the improvement comprising a guide mechanism having a first guide structure comprising a first guide plate and a first opposed guide plate and positioned generally downwardly from said printing station and providing a path for the first record medium and said first guide plate having a surface engageable by said first record medium, a second guide structure comprising a second guide plate and a second opposed guide plate and positioned generally rearwardly of said printing station and providing a path for the second record medium, and guide means positioned at the confluence of the two paths and comprising a spring plate having one end thereof pressing against said surface of the first guide plate of the first guide structure, said spring plate comprising a first portion secured to the first opposed guide plate and a second portion formed integral with and approximately normal to the first portion and said one end of the second portion of said spring plate being engageable with said one surface of said first guide plate, said one end of the second portion of said spring plate being moved from contact with said surface of said first guide plate solely by passage of said first record medium between said one end and said one surface to permit advancement of said first record medium in a path toward the printing station, and said spring plate being formed to return said one end thereof into contact with said surface and in position to close the path of said first record medium and to direct said second record medium along the path of said second guide structure.

6. In the printer of claim 5 wherein said first guide plate is formed upwardly toward said printing station and said first opposed guide plate is spaced from said first guide plate and has an end portion engageable by the second portion of said spring plate and said first opposed guide plate is formed to guide said first record medium along said first guide plate toward said printing station.

7. In the printer of claim 5 wherein said second guide plate extends from said printing station and said second opposed plate is spaced from said second guide plate and has an end portion approaching said spring plate at the confluence of the two paths, the end portion being positioned to permit said spring plate to be moved from contact with said surface.

8. In the printer of claim 5 wherein said first opposed guide plate includes a curved portion engageable by said second portion of said spring plate and is positioned to train said first record medium past said one end of said spring plate and toward said printing station.

* * * * *